US010661474B2

(12) United States Patent
Kloss et al.

(10) Patent No.: US 10,661,474 B2
(45) Date of Patent: May 26, 2020

(54) APPARATUS AND METHOD FOR SEPARATING A CONCRETE BLOCK FROM A FORM

(71) Applicant: Redi-Rock International, LLC, Charlevoix, MI (US)

(72) Inventors: Jacob Kloss, Harbor Springs, MI (US); Matthew Walz, Petoskey, MI (US)

(73) Assignee: Redi-Rock International, LLC, Charlevoix, MI (US)

( * ) Notice: Subject to any disclaimer, the term of this patent is extended or adjusted under 35 U.S.C. 154(b) by 0 days.

(21) Appl. No.: 16/177,520

(22) Filed: Nov. 1, 2018

(65) Prior Publication Data

US 2019/0134847 A1 May 9, 2019

Related U.S. Application Data

(60) Provisional application No. 62/582,991, filed on Nov. 8, 2017.

(51) Int. Cl.

| | |
|---|---|
| ***B28B 7/10*** | (2006.01) |
| ***B28B 7/00*** | (2006.01) |
| ***B28B 13/06*** | (2006.01) |
| ***E04G 19/00*** | (2006.01) |

(52) U.S. Cl.

CPC ..... *B28B 7/0035* (2013.01); *B28B 7/0041* (2013.01); *B28B 7/0044* (2013.01); *B28B 7/10* (2013.01); *B28B 13/06* (2013.01); *E04G 19/00* (2013.01)

(58) Field of Classification Search

CPC ..... B28B 7/0044; B28B 7/10; B28B 13/06; B28B 7/0035; B28B 7/0041

USPC ..... 264/334; 425/442, 444; 249/67, 68

See application file for complete search history.

(56) References Cited

U.S. PATENT DOCUMENTS 2,304,660 A * 12/1942 Scott ..... B28B 7/0044 249/162
3,009,229 A * 11/1961 Tumey ..... B28B 7/0044 425/186
4,874,308 A * 10/1989 Atlas ..... B29C 33/10 425/544
4,889,311 A * 12/1989 Anglin ..... B22D 17/2236 249/68
5,817,248 A * 10/1998 Forlini ..... B28B 7/0044 249/68

(Continued)

FOREIGN PATENT DOCUMENTS

CN 2749655 Y 1/2006
DE 802325 C * 2/1951 ..... B28B 7/0044

(Continued)

OTHER PUBLICATIONS

European Patent Office, European Search Report with written opinion issued in Application EP18204454.5, dated Mar. 21, 2019, 8 pages.

*Primary Examiner* — Michael Safavi
(74) *Attorney, Agent, or Firm* — Traverse Legal, PLC

(57) ABSTRACT

A form for separating a concrete block and a method for separating a concrete block from the form. The formed concrete block remains stationary while the doors of the form are pulled away from the concrete block in order to more conveniently, efficiently, and safely obtain access to the formed concrete block for its removal.

17 Claims, 11 Drawing Sheets

(56) References Cited

U.S. PATENT DOCUMENTS

| | | | | |
|---|---|---|---|---|
| 6,557,818 | B2 * | 5/2003 | Manthci | B28B 7/0044 249/101 |
| 7,918,628 | B1 * | 4/2011 | Siver | B28B 7/0044 405/286 |
| 7,992,837 | B2 | 8/2011 | Davies et al. | |
| 8,753,103 | B1 | 6/2014 | Collison et al. | |
| 9,011,137 | B2 | 4/2015 | Garrett et al. | |
| 2001/0026734 | A1 | 10/2001 | Manthei | |
| 2002/0104952 | A1 * | 8/2002 | Sanger | B28B 7/10 249/39 |
| 2005/0257457 | A1 | 11/2005 | Sumrall | |
| 2008/0174049 | A1 | 7/2008 | Hammer et al. | |
| 2015/0275464 | A1 | 10/2015 | Sharp | |

FOREIGN PATENT DOCUMENTS

| | | | | |
|---|---|---|---|---|
| EP | 2014429 | A2 * | 1/2014 | B28B 7/0044 |
| FR | 982660 | A * | 6/1951 | B28B 7/0017 |
| JP | 2006326944 | A | 12/2006 | |
| SU | 1243947 | A1 * | 7/1986 | B28B 7/0044 |
| SU | 1412970 | A1 * | 7/1988 | B28B 7/0044 |

* cited by examiner

FIG. 8
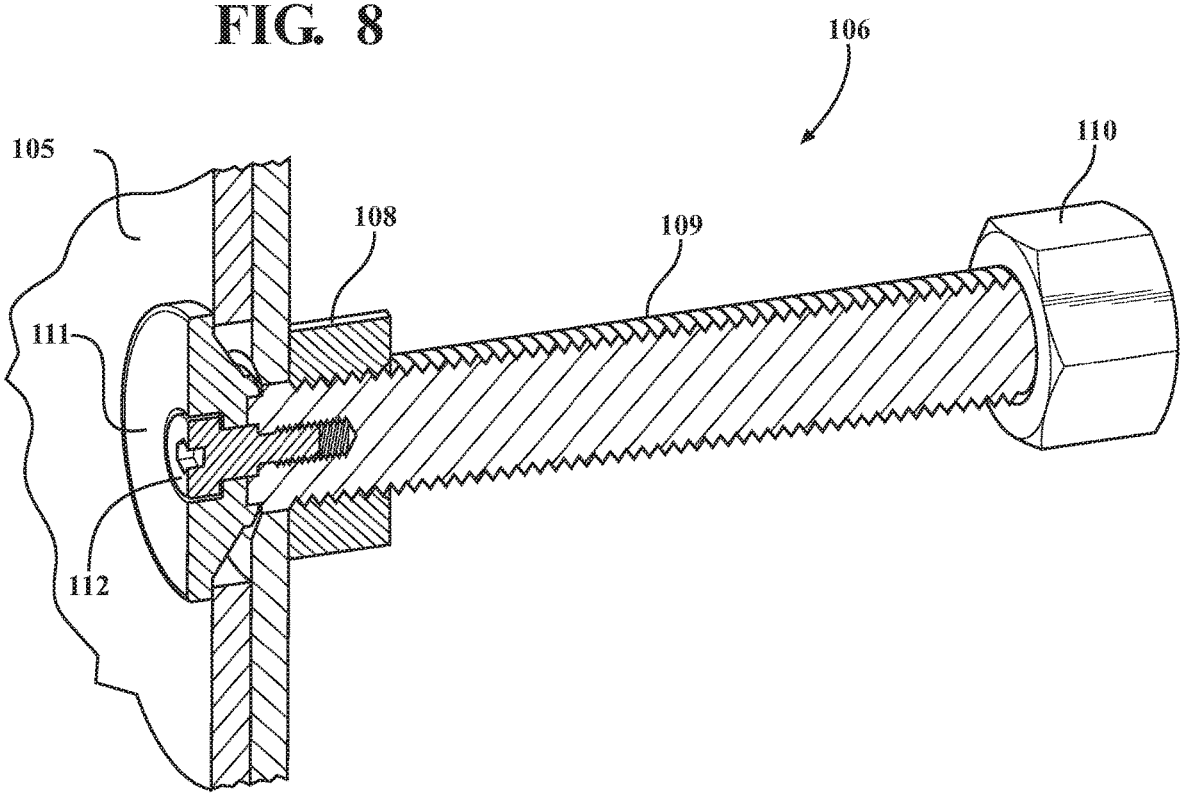
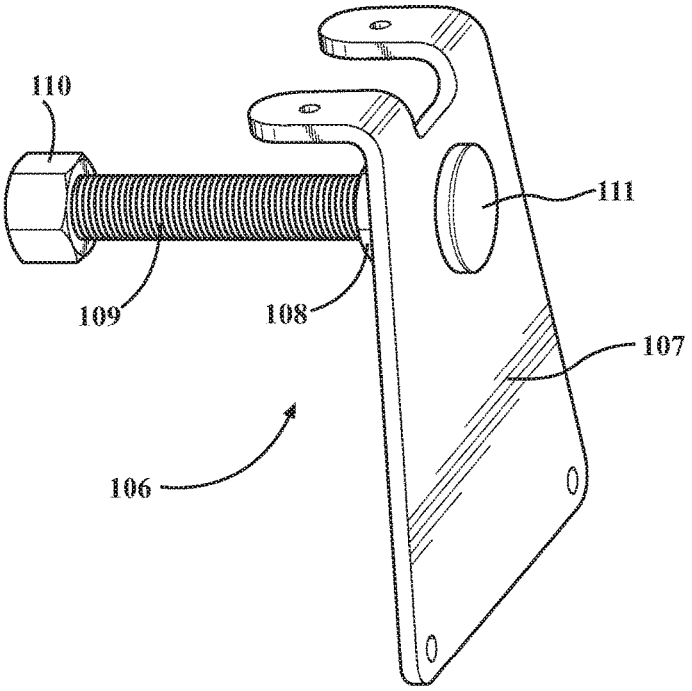
FIG. 9

APPARATUS AND METHOD FOR SEPARATING A CONCRETE BLOCK FROM A FORM

PRIORITY CLAIM

This patent application claims priority to and the benefit of the filing date of the provisional U.S. patent application Ser. No. 62/582,991 filed on Nov. 8, 2017, which is incorporated herein in its entirety.

FIELD

This patent application generally relates to an apparatus and method for separating a concrete block from a form.

BACKGROUND

Some conventional forms for making concrete blocks do not provide operators with convenient access to concrete blocks cast in the forms. Instead, operators are typically required to exert significant amounts of time and labor into separating concrete blocks from their forms in order to remove the formed concrete blocks. In many cases, operators must use specialized equipment to separate the concrete blocks from their forms and to obtain access to the formed concrete blocks, which is particularly the case for forms that produce pre-cast modular blocks (i.e. wet-cast blocks). As such, there are significant safety risks presented to the operators of such forms.

Other conventional forms use hand cranks to rotate threaded screws into the mold to separate it from the block by pushing or pulling opposing structures of the form. However, these forms often require significant structural rigidity to transfer ejection force between the opposing form structure, which results in additional complexity, materials, and cost to the operators of these forms.

Yet other conventional forms directly push on concrete blocks to aid in the removal of the blocks from their respective forms. However, these forms cause the concrete blocks to move, which often results in damage to the concrete blocks that may prevent use of these blocks. This is particularly problematic for wet-cast concrete blocks that weigh several tons. Consequently, there is a need for an improved form and method for separating a concrete block (i.e., a wet-cast concrete block) from the form to allow for easier, safer, and quicker removal of the concrete block, without causing damage to the concrete block.

SUMMARY

What is provided is a form for separating a concrete block and a method for separating a concrete block from the form. The result is an easier, safer, and more efficient mechanism for separating and removing a concrete block, such as a wet-cast concrete block, without causing damage to the concrete block. The formed concrete block remains stationary while the doors of the form are pulled away from the concrete block in order to more conveniently, efficiently, and safely obtain access to the formed concrete block for its removal.

In an exemplary embodiment, the form comprises a mold insert defining a cavity, wherein a concrete block is cast in the cavity; one or more side doors disposed around of the concrete block, wherein the one or more side doors are operably configured to move towards and away from the concrete block, and wherein each of the one or more side doors comprises an aperture; and one or more pressure-transfer mechanisms securely connected to each of the one or more side doors, wherein the one or more pressure-transfer mechanisms are operably configured to apply a release force inside the cavity to separate the concrete block from the one or more side doors, and wherein the concrete block remains substantially stationary during separation of the concrete block from the form.

In some embodiments, each of the pressure-transfer mechanisms comprises a fastener having a first end and a second end, wherein the first end extends through the aperture on the one or more side doors and into the cavity, wherein the first end includes a block-contacting surface configured to selectively engage with the concrete block, and wherein the fastener is attached to the one or more side doors via one or more nuts in rigid contact with a mating surface on each of the one or more side doors.

In other embodiments, the pressure-transfer mechanisms are one or more air supply lines, one or more hydraulic cylinders, and/or one or more mechanical linkage rods.

In an exemplary embodiment, the method for separating a concrete block from a form comprises the steps of:

(a) providing the form comprising:
  one or more side doors disposed around of the concrete block, wherein the one or more side doors are operably configured to move towards and away from the concrete block, wherein each of the one or more side doors comprises an aperture;
  one or more pressure-transfer mechanisms securely connected to the one or more side doors;
(b) releasing the one or more side doors to unlock the form;
(c) applying a release force to the one or more side doors by applying a torque to the pressure-transfer mechanism until the one or more side doors are not in contact with the concrete block; and
(d) pushing the one or more side doors away from the block to fully open the form, wherein the concrete block remains stationary during each of steps (a)-(d).

In some embodiments, each of the pressure-transfer mechanisms comprises a fastener having a first end and a second end, wherein the first end extends through the aperture on the one or more side doors and into the cavity, wherein the first end includes a block-contacting surface configured to selectively engage with the concrete block, and wherein the fastener is attached to the one or more side doors via one or more nuts in rigid contact with a mating surface on each of the one or more side doors.

In other embodiments, the pressure-transfer mechanisms are one or more air supply lines, one or more hydraulic cylinders, and/or one or more mechanical linkage rods.

The following detailed description together with the accompanying drawings will provide a better understanding of the nature and advantages of the present invention.

BRIEF DESCRIPTION OF THE DRAWINGS

Subject matter is particularly pointed out and distinctly claimed in the concluding portion of the specification. Claimed subject matter, however, as to structure, organization and method of operation, together with objects, features, and advantages thereof, may best be understood by reference to the following detailed description if read with the accompanying drawings in which:

FIG. 8 is a cross-sectional view of an exemplary pressure-transfer mechanism attached to the form of FIG. 1;

FIG. 9 is a side perspective view of the pressure-transfer mechanism of FIG. 8 engaged with an exemplary bracket;

DETAILED DESCRIPTION

In the following detailed description, numerous specific details are set forth in order to provide a thorough understanding of the examples as defined in the claimed subject matter, and as an example of how to make and use the examples described herein. However, it will be understood by those skilled in the art that claimed subject matter is not intended to be limited to such specific details, and may even be practiced without requiring such specific details. In other instances, well-known methods, procedures, and ingredients have not been described in detail so as not to obscure the invention defined by the claimed subject matter.

Directional terms, such as "top," "bottom," "inwards," "upwards," "downwards," "perpendicular," "parallel," and "laterally" are used in following detailed description for the purpose of providing relative reference only, and are not intended to suggest any limitations on how any article is to be positioned during use, or to be mounted in an assembly or relative to an environment.

Among other things, this application discloses a form and a method for separating the form from the formed concrete block to facilitate its removal. The formed concrete block remains substantially stationary while the doors of the form are pulled away from the concrete block in order to more conveniently, efficiently, and safely obtain access to the formed concrete block for its removal. As a result, the amount of potential damage to the concrete block is greatly reduced and the concrete block material is preserved.

Figure 1:
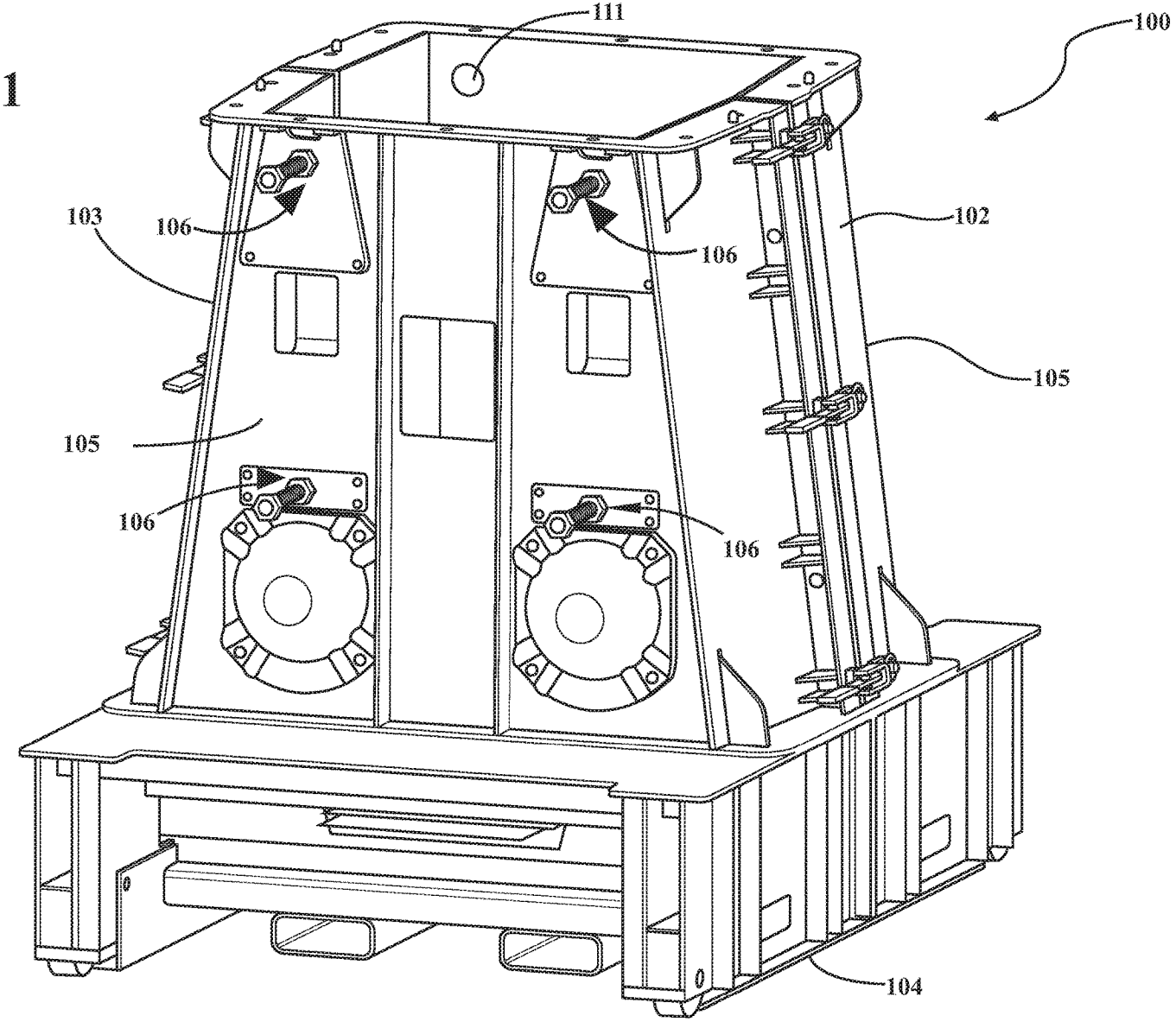
FIG. 1 is a side perspective view of an exemplary form having an assembly for separating a concrete block from the form.
Figure 2:
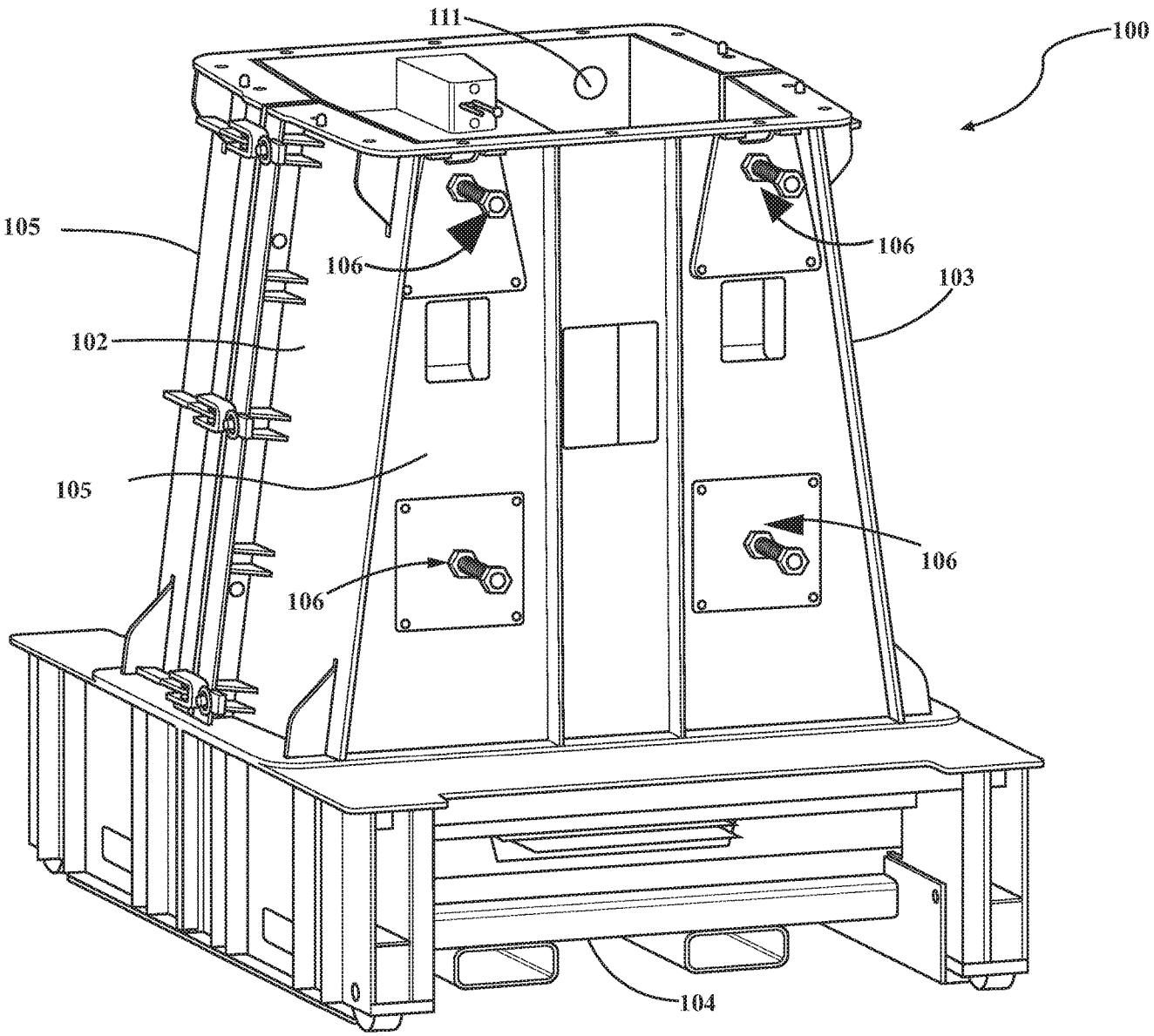
FIG. 2 is another side perspective view of the form of FIG. 1.
Figure 3:
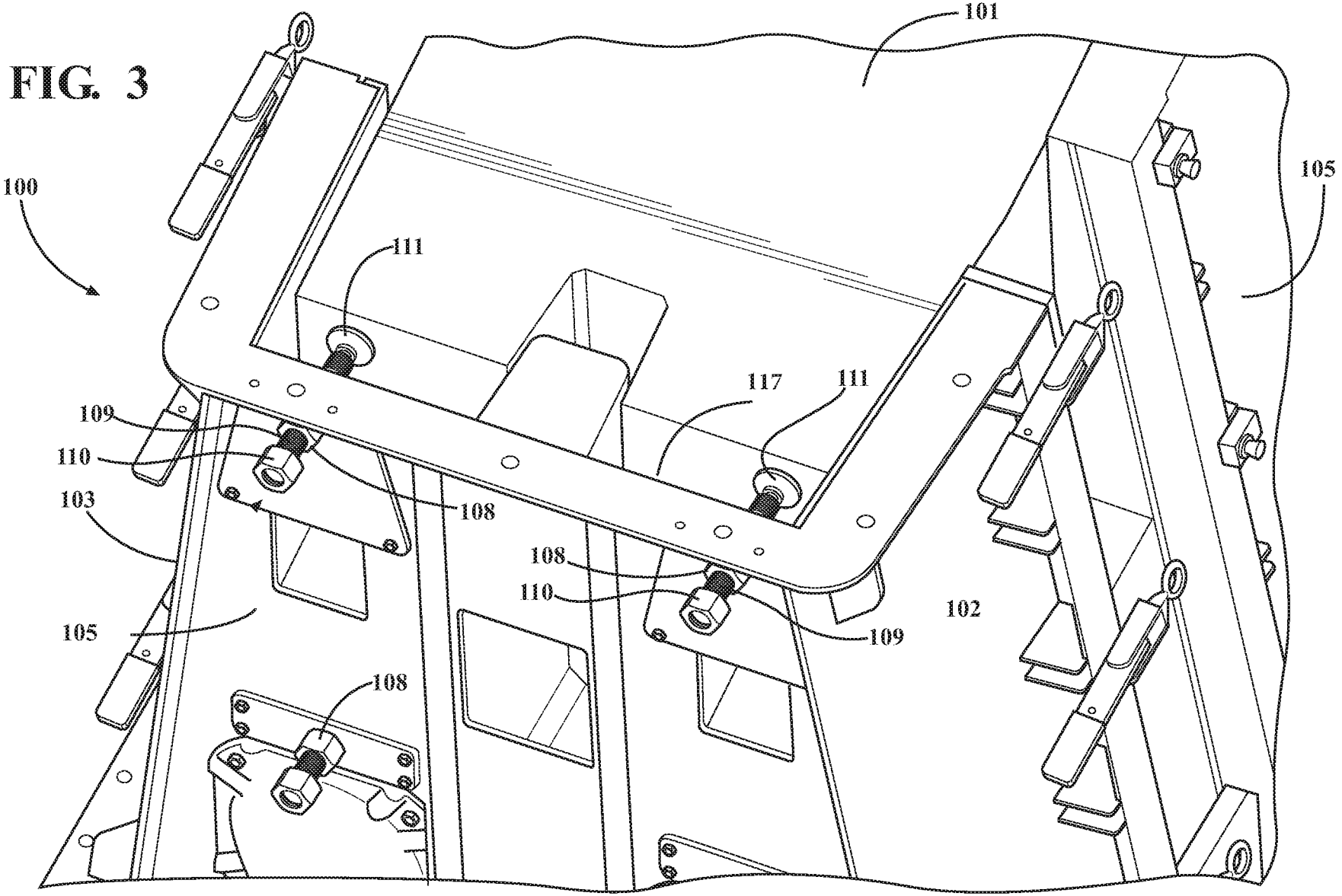
FIG. 3 is a top perspective view of the form of FIG. 1 including a concrete block.
Figure 4:
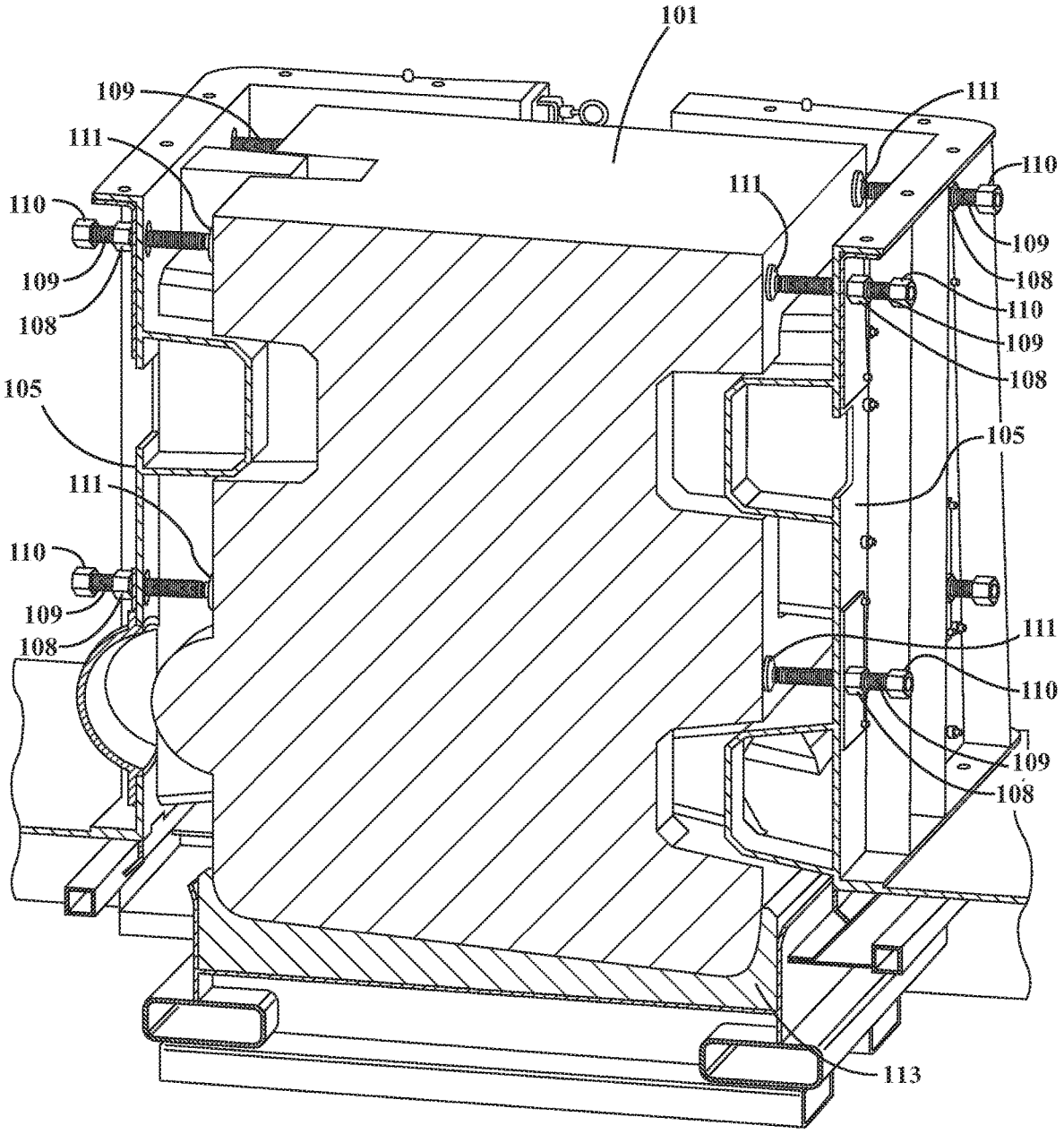
FIG. 4 is a front perspective view of the form of FIG. 1 including a concrete block.
Figure 5:
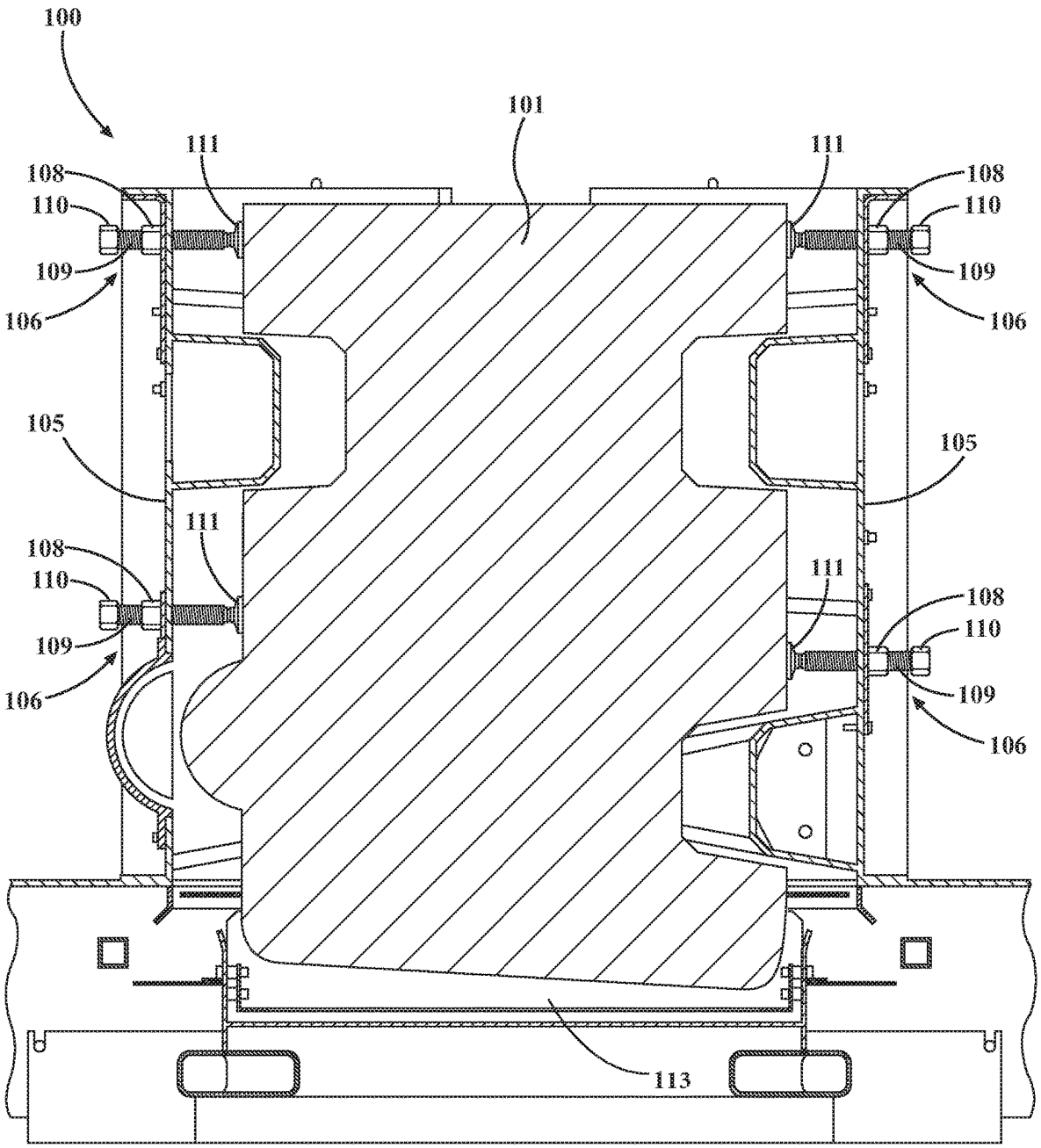
FIG. 5 is a front elevation view of the form of FIG. 1 including a concrete block.
Figure 6A:
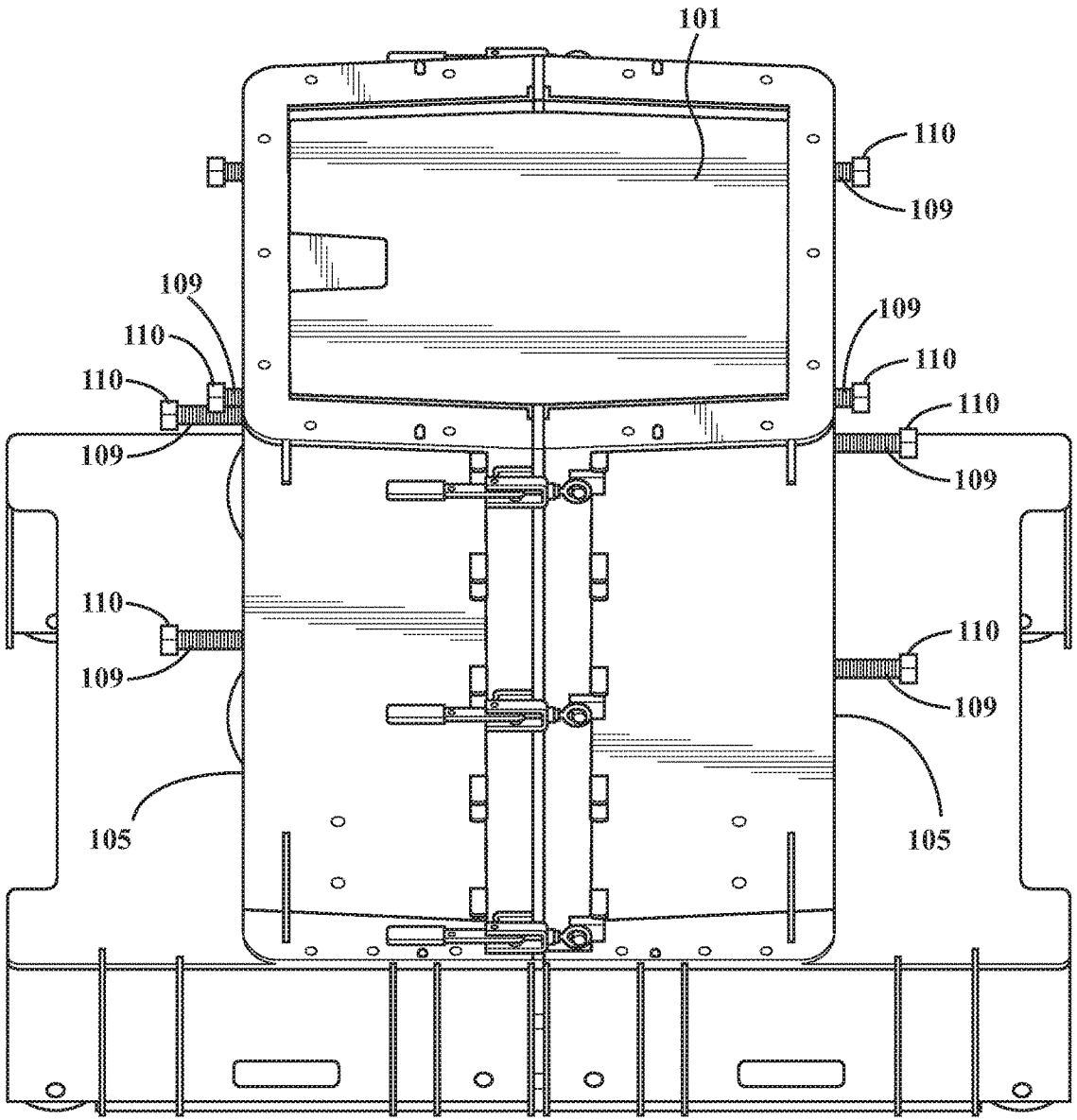
FIG. 6A is a front plan view of the form of FIG. 1 in a fully closed orientation and including a concrete block.
Figure 6B:
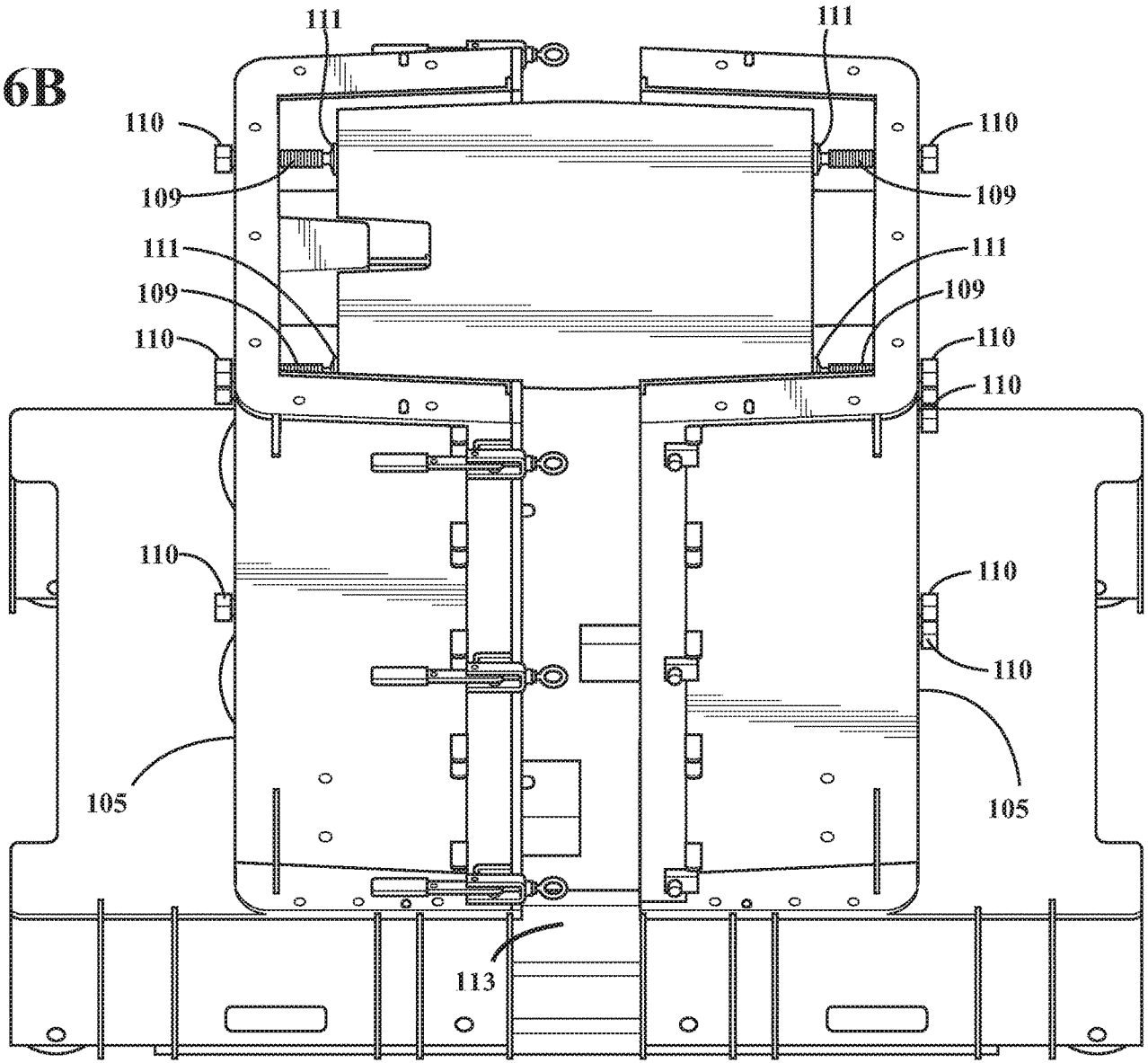
FIG. 6B is a front plan view of the form of FIG. 1 in a partially opened orientation and including a concrete block.

Referring to FIGS. 1-6B, FIGS. 1-6B show an exemplary form 100 comprising an assembly for separating a concrete block 101 from the form 100 to facilitate removal of the concrete block 101. In some embodiments, the concrete block 101 is a partially cured concrete block. FIGS. 1-6(*b*) show various views of the form 100. FIGS. 1-4 are perspective views of the form 100; FIG. 5 is a front elevation view of the form 100; and FIGS. 6A and 6B are front plan views of the form 100.

The form 100 has six sides: a front side 102, a rear side 103, a bottom side 104, and one or more side doors 105. Each of the side doors 105 may be operably configured to extend toward and away from the center of the form 100 to provide access to the formed concrete block 101.

The form 100 includes a textured mold insert 113 that defines a cavity 117 for casting the concrete block 101. The mold insert 113 may be configured to imprint a decorative pattern onto the concrete block 101 cast in the cavity 117 such that the face of the concrete block 101 may imitate natural stone or other aesthetically pleasing materials.

The form 100 comprises one or more modular pressure-transfer mechanisms 106. Each of the pressure-transfer mechanism 106 may be configured to apply a release force between the form 100 and the concrete block 101 in order to pull apart the side doors 105 from the concrete block 101. In some embodiments, the pressure-transfer mechanisms 106 may be securely attached directly to each of the side doors 105 through one or more apertures on each of the side doors 105.

Figure 10:
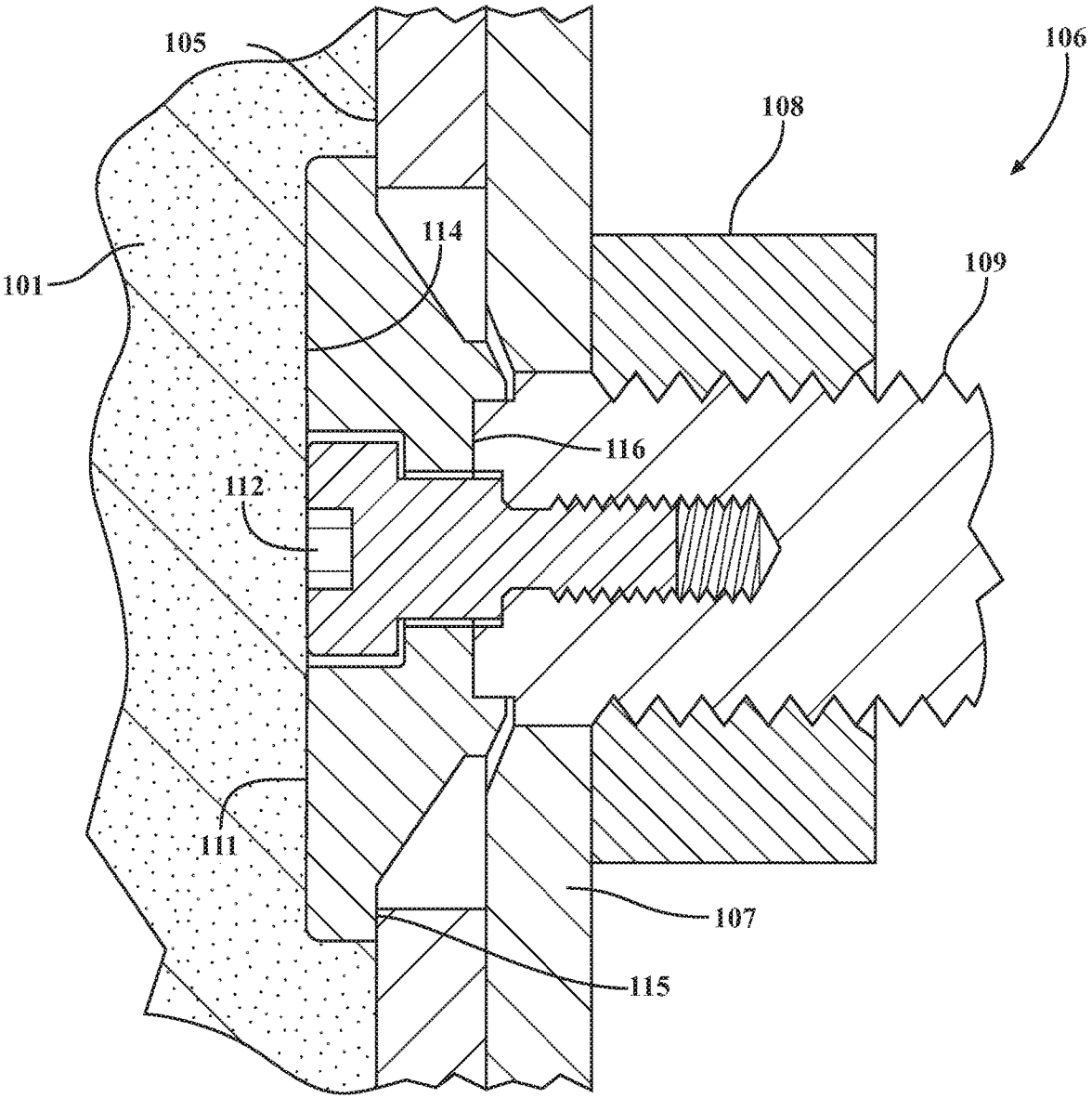
FIG. 10 is an enlarged cross-sectional view of the pressure-transfer mechanism of FIG. 8.

In other embodiments, modular door mating brackets 107 and a nut, such as a welded drive nut 108, as shown in FIGS. 8 and 10. Other structures that may be used in other embodiments include supports, frames, and/or racks. The shape of the modular door mating bracket 107 may vary depending on factors, such as the location of attachment on the side doors 105 and the height and width of the side doors 105.

In an embodiment, each of the side doors 105 comprises four modular door mating brackets 107 and four welded drive nuts 108. In this embodiment, two of the modular door mating brackets 107 have a substantially trapezoidal shape and two of the modular door mating brackets 107 have a substantially rectangular shape. The modular door mating brackets 107 may be made from any suitable material, such as stainless steel or another metallic alloy or a polymer. In other embodiments, each of the side doors 105 comprises from one to three modular door mating brackets 107. In yet other embodiments, each of the side doors 105 comprises more than four modular door mating brackets 107.

In the embodiment shown in FIG. 5, the pressure-transfer mechanisms 106 apply the preload force/pressure between the form 100 and the concrete block 101 via a fastener 109 to facilitate the removal of the formed concrete block 101 from the form 100. The fastener 109 may be any apparatus used for joining of metallic materials, such as a screw, a bolt, a stud, or a threaded rod.

As shown in FIGS. 8-10, each of the pressure-transfer mechanisms 106 may have a fastener 109 (e.g. coil rod) that can be inserted through the interior of the form 100. The threaded fastener 109 (e.g. coil rod) extends into the cavity 117 and a side of the concrete block 101 when the concrete block 101 is ready to be separated from the form 100. A coil rod nut 110 may be welded to the end of the threaded coil rod 109 that is then inserted through the form 100, as shown in FIGS. 8-10. The coil rod nut 110 is configured for the application of user-applied force when positioning the threaded fastener 109 (e.g. coil rod) in a desired location with respect to the concrete block 101.

In other embodiments, pressure-transfer mechanisms can apply the preload force/pressure between a form and a concrete block via air supply lines, hydraulic systems, mechanical linkages, and/or external reaction frames. In the hydraulic systems example, there may either a single hydraulic system or a plurality of hydraulic systems on each side door configured to simultaneously push on each of the pressure-transfer mechanisms.

Figure 7:
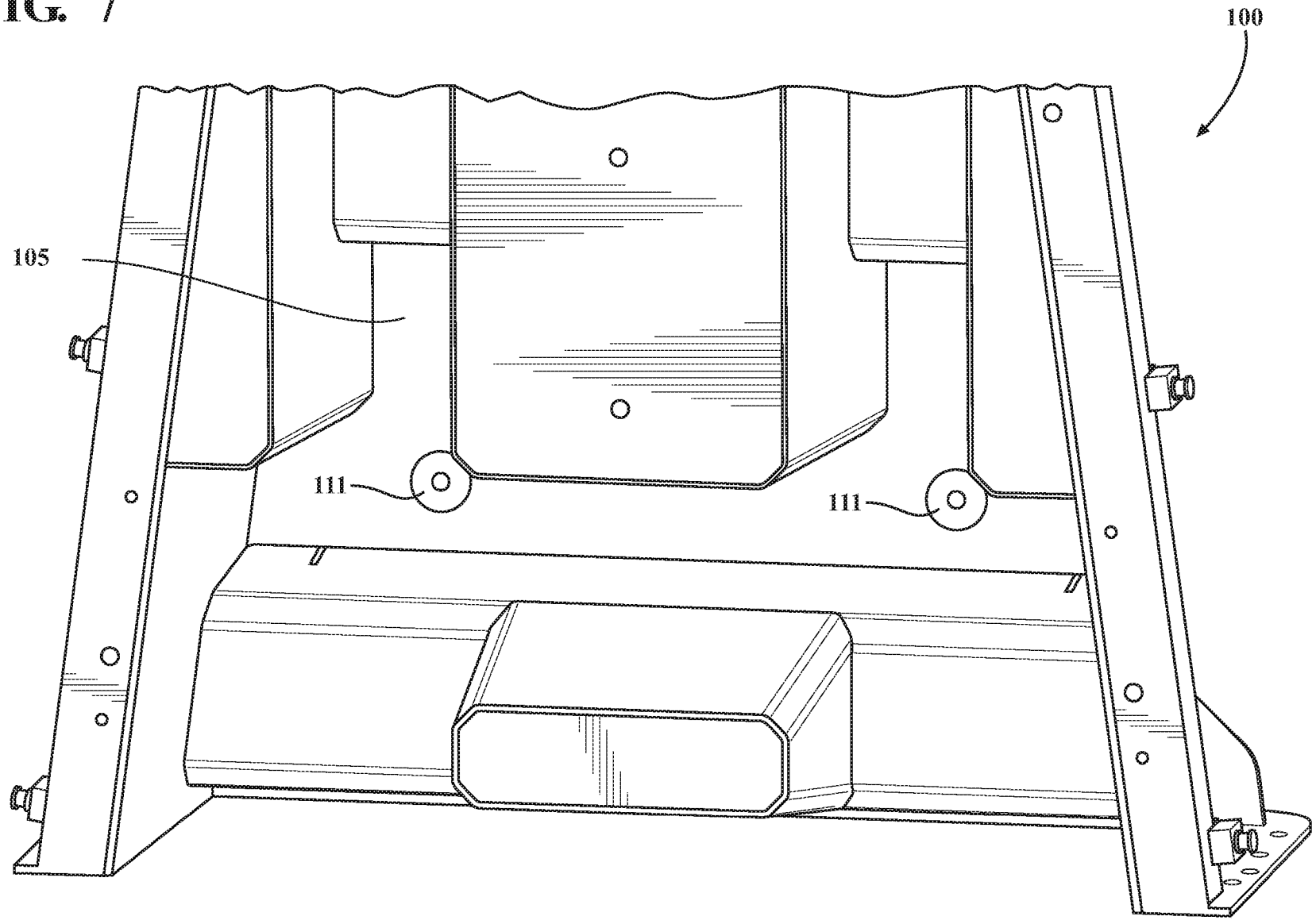
FIG. 7 is a partial cut-away view of the interior portion of the form of FIG. 1 having an exemplary pad.

Each of the pressure-transfer mechanisms 106 further comprises a surface configured to selectively engage with sides of the concrete block 101 in order to transfer the axial compressive force/pressure encountered when engaging with the concrete block 101. In an embodiment, the surface is a pad 111 made from steel or other suitable material that is resilient to high force and surface wear. FIG. 7 shows a cut-away view of an interior portion of a side door 105 including the pad 111.

As shown in FIG. 10, the pad 111 comprises a block-contacting surface 114, a flange 115, and a rod-contacting surface 116. The block-contacting surface 114 is configured to transfer pressure when engaging with the concrete block 101 during the removal of the concrete block 101 from the form 100. The block-contacting surface 114 allows the pad 111 to statically mate to the concrete block 101 in a manner that prevents any rotation of the pad 111. Since the interface between the pad 111 and the concrete block 101 is static, the concrete block 101 remains substantially stationary during its separation from the form 100. This greatly reduces any potential damage to the concrete block 101.

In the embodiment shown in FIG. 10, the flange 115 provides a static planar interface between the concrete block 101, the pad 111, and the form 100. Specifically, during the pouring of concrete into the form 100, the flange 115 acts to protect the threaded coil rod 109 from concrete during initial curing. The flange 115 is also configured to act as the set point for proper placement of the pressure-transfer mechanisms 106 prior to pouring concrete into the form 100. By having a repeatable and controllable placement of the pad 111, the operator of the form 100 does not need to visually check or physically measure the placement of the pad 111 prior to pouring the concrete. Instead, the operator can save time by simply reversing/retracting the threaded coil rod 109 until it stops.

In the embodiment shown in FIG. 10, the rod-contacting surface 116 mates directly to the threaded coil rod 109 through a rotary interface. As a result, rotation occurs between the rod-contacting surface 116 and the surface of the threaded coil rod 109 during the rotation of the threaded coil rod 109, which results in axial translation. Due to the improved load distribution created by the pressure-transfer mechanisms 106, the amount of force that a user needs to exert to pull apart the side doors 105 is greatly reduced.

As shown in FIG. 10, the rod-contacting surface 116 is securely coupled to the threaded coil rod 109 through a shoulder bolt 112 inserted within the threaded coil rod 109. Due to the rigid bolt interface between the shoulder bolt 112 and the threaded coil rod 109, the shoulder bolt 112 rotates with the threaded coil rod 109 when the threaded coil rod 109 spins during operation. The shoulder bolt 112 restrains the axial travel of the pad 111 during retraction of the threaded coil rod 109 in order to create a gap or separation between the two, while still permitting the rotation of the threaded coil rod 109. In other embodiments, retaining pins/clips, clevis pins, bearing shafts, and functionally similar components may be used instead of the shoulder bolt 112.

The shoulder bolt 112 may be readily disassembled to allow the pressure-transfer mechanism 106 to be repaired and/or replaced and to adjust the size of the pad 111 (i.e., the block-contacting surface 114). Also, the thread sizing may be modified to optimize the force or the speed of the threaded coil rod 109. For example, a finer, higher pitch thread increases the force of the threaded coil rod 109, while a courser, lower pitch thread increases the speed of the threaded coil rod 109.

FIGS. 6A and 6B show front plan views of the form 100 in a fully closed orientation and a partially opened orientation, respectively. Opening the side doors 105 partially is considered partially stripping the block 101 from the form 100. In one embodiment of the partially opened form 100, the threaded coil rod 109 on each of the pressure-transfer mechanisms 106 is extended about 6 inches from the inside of the form 100 to the respective side of the concrete block 101, as shown in FIG. 6B. In one embodiment, the form 100 is considered fully opened when the pressure-transfer mechanisms 106 push each of the side doors 105 about 6 inches, resulting in each of the side doors 105 travelling about 24 inches to fully open.

As a result of the relative ease in which an operator can use the pressure-transfer mechanisms 106 to pull the side doors 105 away from the concrete block 101, the pressure-transfer mechanisms 106 may be used with forms to assist in building taller, non-solid reinforced walls. For example, the pressure-transfer mechanisms 106 may be used with forms that produce blocks having depths of 52 inches, 6 feet, and 8 feet. Due to the larger block envelope, these blocks may be used to construct walls about 20 feet tall, without any geogrid style reinforcement. The depths of the formed concrete blocks and heights of the resulting walls vary depending on environmental conditions and user preferences. An operator does not need to exert a great amount of force or time or use any specialized equipment in order pull apart the side doors of a form for facilitating removal of a concrete block. Since no soil reinforcement may be needed for such tall forms, minimal additional digging or construction is required at the site of the forms and no property easements need to be obtained.

In exemplary embodiments, the pressure-transfer mechanisms 106 on the form 100 may be used with wet-casting methods for making concrete blocks. Since the amount of damage to formed concrete blocks is greatly reduced or eliminated using the pressure-transfer mechanisms 106 disclosed herein, concrete blocks are removed intact from their respective forms, allowing the material of the concrete blocks to be preserved. This is particularly important with large concrete blocks and forms. By ensuring that the concrete blocks remain substantially stationary during the removal process, the forms disclosed herein are easy to use and cost-effective.

In other embodiments, the pressure-transfer mechanisms 106 on the form 100 are used with dry-casting methods for making concrete blocks.

Figure 11:
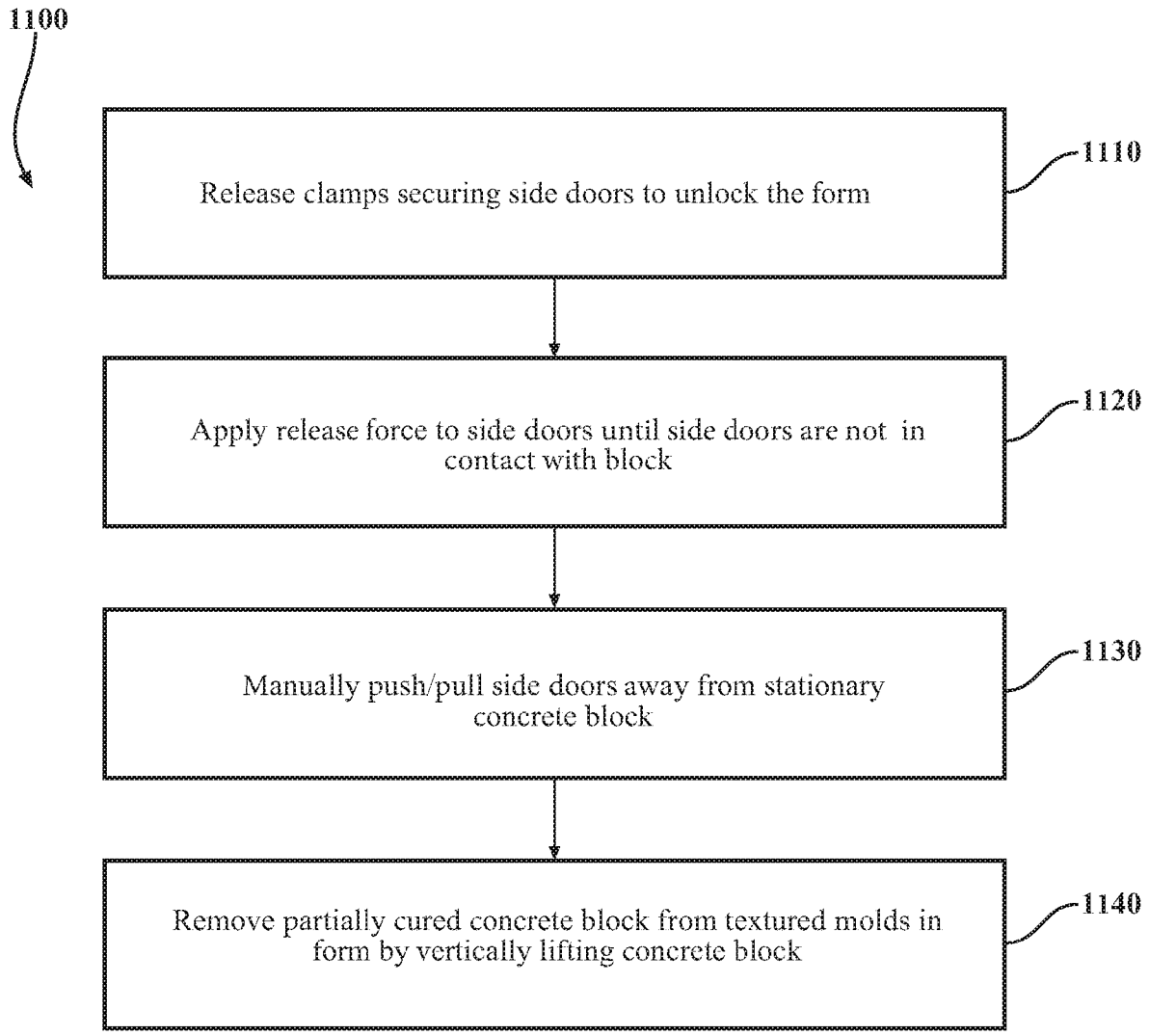
FIG. 11 is a flowchart of an exemplary method for separating a concrete block from the form of FIG. 1.

Referring to FIG. 11, FIG. 11 shows a flowchart of an exemplary method 1100 for separating the partially cured concrete block 101 from the form 100 of FIGS. 1-6B to facilitate removal of the formed concrete block 101. At block 1110, the method 1100 begins with releasing the clamps securing the side doors 105 to unlock the form 100. Next, at block 1120, a release force is applied to the one or more side doors 105 by applying a torque on the pressure-transfer mechanisms 106 located on each of the side doors 105. More specifically, a torque is applied on the fastener 109 until one or more of the side doors 105 are no longer in contact with the concrete block 101, such as by sliding, swinging, and/or translating the one or more side doors 105.

In an embodiment, the torque is applied to four pressure-transfer mechanisms 106 positioned on each of the side doors 105. The torque may be first applied to the two bottom pressure-transfer mechanisms 106 and then to the two upper pressure-transfer mechanisms 106. These steps are repeated until the side doors 105 release away from the concrete block 101.

In an embodiment, the release force may be applied until one of the side doors 105 translates up to six inches away from the stationary concrete block 101. In another embodiment, the release force is applied until both of the side doors 105 translate up to six inches away from the stationary concrete block 101. In yet other embodiments, the release force is applied until the side doors 105 are separated such that the form 100 is considered to be fully open.

Next, the form 100 is fully opened by manually pushing/pulling each of the side doors 105 away from the stationary, partially cured concrete block 101, as shown in block 1130. The partially cured concrete block 101 is then removed from the textured mold insert 113 in the form 100 by vertically lifting the concrete block 101 using specialized equipment, such as a forklift or a crane, as shown in block 1140.

In some embodiments, the release force is applied to one of the side doors 105 before being applied to the other side door 105. In other embodiments, the release force is applied simultaneously to both of the side doors 105 through two users.

Some of the blocks illustrated in the flowchart of FIG. 11 may be performed in an order other than that which is described. Also, it should be appreciated that not all of the blocks in the flow chart are required to be performed, that additional blocks may be needed, and that some of the illustrated blocks may be substituted with other blocks.

It will, of course, be understood that, although particular examples have just been described, the claimed subject matter is not limited in scope to a particular example or limitation. Likewise, an example may be implemented in any combination of compositions of matter, apparatuses, methods or products made by a process, for example.

In the preceding description, various aspects of claimed subject matter have been described. For purposes of explanation, specific numbers, percentages, components, ingredients and/or configurations were set forth to provide a thorough understanding of claimed subject matter. However, it should be apparent to one skilled in the art having the benefit of this disclosure that claimed subject matter may be practiced without the specific details. In other instances, features that would be understood by one of ordinary skill were omitted or simplified so as not to obscure claimed subject matter. While certain features and examples have been illustrated or described herein, many modifications, substitutions, changes or equivalents will now occur to those skilled in the art. It is, therefore, to be understood that the appended claims are intended to cover all such modifications or changes as fall within the true spirit of claimed subject matter.

What is claimed is:

1. A form for casting a concrete block, the form comprising:

a mold insert defining a cavity, wherein a concrete block is cast in the cavity;

one or more side doors disposed around the concrete block, wherein the one or more side doors are operably configured to move towards and away from the concrete block, and wherein each of the one or more side doors comprises an aperture; and one or more pressure-transfer mechanisms securely connected to each of the one or more side doors, wherein the one or more pressure-transfer mechanisms are operably configured to apply a release force inside the cavity to separate the concrete block from the one or more side doors, and wherein the concrete block remains substantially stationary during separation of the concrete block from the form;

wherein each of the pressure-transfer mechanisms comprises a fastener having a first end and a second end, wherein the first end extends through the aperture on the one or more side doors and into the cavity, and wherein the first end includes a pad configured to selectively engage with the concrete block, and wherein the fastener is attached to the one or more side doors via one or more nuts in contact with a mating surface on each of the one or more side doors; and wherein the fastener includes a shoulder bolt, wherein the shoulder bolt is operably configured to mate the pad to the fastener and to restrain the axial movement of the pad when the fastener is retracted.

2. A form for casting a concrete block, the form comprising:

a mold insert defining a cavity, wherein a concrete block is cast in the cavity;

one or more side doors slidingly disposed around of the concrete block, wherein the one or more side doors are operably configured to move towards and away from the concrete block, and wherein each of the one or more side doors comprises an aperture; and one or more pressure-transfer mechanisms securely connected to each of the one or more side doors, wherein the one or more pressure-transfer mechanisms are operably configured to apply a release force inside the cavity to separate the concrete block from the one or more side doors, and wherein the concrete block remains substantially stationary during separation of the concrete block from the form.

3. The form of claim 2, wherein each of the pressure-transfer mechanisms comprises a fastener having a first end and a second end, wherein the first end extends through the aperture on the one or more side doors and into the cavity, and wherein the first end includes a block-contacting surface configured to selectively engage with the concrete block, and wherein the fastener is attached to the one or more side doors via one or more nuts in contact with a mating surface on each of the one or more side doors.

4. The form of claim 3, wherein the fastener is attached to the one or more side doors via one or more nuts, wherein the nuts are in contact with a mating surface on each of the one or more side doors.

5. The form of claim 4, wherein the mating surface on each of the one or more side doors is a bracket, a support, a frame, and/or a rack.

6. The form of claim 3, wherein the fastener is a screw, a bolt, a stud, and/or a rod.

7. The form of claim 3, wherein the block-contacting surface is a non-rotating pad.

8. The form of claim 7, wherein the pad comprises a flange, wherein the flange provides a static planar interface between the concrete block, the pad, and the form.

9. The form of claim 7, wherein the fastener includes a shoulder bolt, wherein the shoulder bolt is operably configured to mate the pad to the fastener and to restrain the axial movement of the pad when the fastener is retracted.

10. The form of claim 9, wherein the shoulder bolt is selected from the group consisting of a retaining clip, a retaining pin, a clevis pin, or a bearing shaft.

11. The form of claim 2, wherein the one or more pressure-transfer mechanisms are one or more air supply lines, one or more hydraulic cylinders, and/or one or more mechanical linkages.

12. A method for separating a concrete block from a form, the method comprising the steps of:

(a) providing the form comprising:

one or more side doors slidingly disposed around the concrete block, wherein the one or more side doors are operably configured to move towards and away from the concrete block, wherein each of the one or more side doors comprises an aperture; and one or more pressure-transfer mechanisms securely connected to the one or more side doors;

(b) releasing the one or more side doors to unlock the form;

(c) applying a release force to the one or more side doors by applying a torque to the pressure-transfer mechanism until the one or more side doors are not in contact with the concrete block; and (d) pushing the one or more side doors away from the block to fully open the form, wherein the concrete block remains stationary during each of steps (a)-(d).

13. The method of claim 12, wherein each of the pressure-transfer mechanisms comprises a fastener having a first end and a second end, wherein the first end of the fastener extends through the aperture on the one or more side doors and into the cavity, and wherein the first end includes a non-rotating pad that selectively mates to a portion of the concrete block.

14. The method of claim 13, wherein the fastener is attached to the one or more side doors via one or more nuts, wherein the nuts are in contact with a mating surface on each of the one or more side doors.

15. The method of claim 14, wherein the mating surface on each of the one or more side doors is a bracket, a support, a frame, and/or a rack.

16. The method of claim 13, wherein the fastener is a screw, a bolt, a stud, and/or a rod.

17. The method of claim 12, wherein the one or more pressure-transfer mechanisms are one or more air supply lines, one or more hydraulic cylinders, and/or one or more mechanical linkages.

* * * * *